US010342334B1

(12) United States Patent
Abel

(10) Patent No.: US 10,342,334 B1
(45) Date of Patent: Jul. 9, 2019

(54) UPPER-SHELF ASSEMBLY

(71) Applicant: Don E. Abel, Olney, IL (US)

(72) Inventor: Don E. Abel, Olney, IL (US)

( * ) Notice: Subject to any disclaimer, the term of this patent is extended or adjusted under 35 U.S.C. 154(b) by 2 days.

(21) Appl. No.: 15/813,925

(22) Filed: Nov. 15, 2017

Related U.S. Application Data

(60) Provisional application No. 62/423,263, filed on Nov. 17, 2016.

(51) Int. Cl.
*A47B 9/00* (2006.01)
*A47B 57/06* (2006.01)
*A47B 96/07* (2006.01)

(52) U.S. Cl.
CPC ..... *A47B 57/06* (2013.01); *A47B 96/07* (2013.01)

(58) Field of Classification Search
CPC ..... A47B 46/005; A47B 51/00; A47B 57/06; A47B 96/07
USPC ..... 312/334.7
See application file for complete search history.

(56) References Cited

U.S. PATENT DOCUMENTS 5,586,816 A * 12/1996 Geiss, II ..... A47B 46/00 312/301
6,471,311 B1 * 10/2002 Snyder ..... A47B 51/00 312/245
6,755,492 B1 * 6/2004 Hyde ..... A47B 51/00 312/247
7,770,986 B1 * 8/2010 Simaitis ..... A47B 51/00 312/246
8,251,465 B2 * 8/2012 Yu ..... H05K 7/1489 312/334.7
8,382,218 B2 * 2/2013 Placke ..... F25D 25/025 312/334.7
2004/0155563 A1 * 8/2004 Young ..... A47B 88/49 312/334.8
2006/0103273 A1 * 5/2006 Lee ..... A47B 51/00 312/236
2011/0234067 A1 * 9/2011 Vicek ..... A47B 46/00 312/249.1
2012/0194042 A1 * 8/2012 Greenberg ..... A47B 46/00 312/107
2012/0313494 A1 * 12/2012 Chow ..... A47B 51/00 312/298
2013/0241384 A1 * 9/2013 Strauss ..... A47B 51/00 312/319.5
2014/0203692 A1 * 7/2014 Marsters ..... A47B 46/005 312/246

* cited by examiner

*Primary Examiner* — Matthew W Ing
(74) *Attorney, Agent, or Firm* — Gary K. Price

(57) ABSTRACT

An upper-shelf assembly having a vertical rear wall extending the width of the assembly, and a bottom surface in communication with the vertical rear wall. Horizontal and vertical base tracks are mounted with the sides of the cabinet's side walls, the horizontal base tracks retractable in a horizontal orientation, and the vertical base tracks retractable in a vertical orientation. The assembly includes a rest or storage position where the assembly is positioned with the cabinet's selected shelf, a first position where the bottom surface is horizontally extended from the selected shelf and, a second position where the assembly is horizontally extended and then vertically lowered from the selected shelf so that goods stored on the bottom surface of the assembly have easier visibility and are easier to access, remove or replace.

18 Claims, 4 Drawing Sheets

UPPER-SHELF ASSEMBLY

CROSS REFERENCES TO RELATED APPLICATIONS

U.S. Provisional Application for Patent No. 62/423,263, filed Nov. 17, 2016, with title "Upper-Shelf Assembly" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention relates to storage shelves, and more particularly, to a shelf organizer adapted to be used on a shelf and, preferably on a shelf within a storage cabinet.

2. Brief Description of Prior Art

Storage cabinets have long been known. Generally, such cabinets have a number of horizontal shelves supported at various heights within a housing. The overall size of the cabinet, the width and depth of its shelves, the number of shelves, and the various heights at which the shelves are mounted are all selected with a view toward the intended use of the cabinet and the maximum use of available space.

Regardless of the storage cabinet's size and/or configuration, most storage cabinets suffer from a similar disadvantage in that the storage cabinet includes upper shelves that create difficulty in seeing, removing and replacing desired goods stored on the upper shelf.

The modern consumer has need of a storage cabinet for common storage that allows for ease of visibility from all shelves within the cabinet, including the top shelf, and to allow for easy removal or replacement of goods on the upper shelves. The assembly should be easily installed with existing shelving within the storage cabinet, and provide simple installation using common household tools. Accordingly, there is a need for such a upper-shelf assembly.

SUMMARY OF THE INVENTION

An upper-shelf assembly having a vertical rear wall extending the width of the assembly, and a bottom surface in communication with the vertical rear wall.

The bottom surface for storing various goods. The assembly generally includes a defined first position where the bottom surface is horizontally extended from the cabinet's selected shelf surface, and a second position where the assembly including the bottom surface is horizontally extended and vertically lowered from the selected shelf surface.

Horizontal base tracks are appropriately mounted in a spaced parallel relationship by fasteners with the sides of the storage cabinet and are retractable in a horizontal orientation. Similarly, vertical base tracks are appropriately mounted in a spaced parallel relationship by fasteners with the sides of the cabinet and are retractable in a vertical orientation.

The assembly further includes a pair of side members having a lower edge appropriately attached to the horizontal base tracks and an upper edge appropriately attached to the vertical base tracks.

In application, the assembly includes a rest or storage position where the assembly is positioned with the selected shelf. The assembly includes a first position where the bottom surface is horizontally extended from the selected shelf and, a second position where the assembly including the bottom surface is horizontally extended (first position) and then vertically lowered from the selected shelf so that goods stored on the bottom surface of the assembly have easier visibility and are easier to access, remove or replace.

DESCRIPTION OF THE PREFERRED EMBODIMENT

Figure 1:
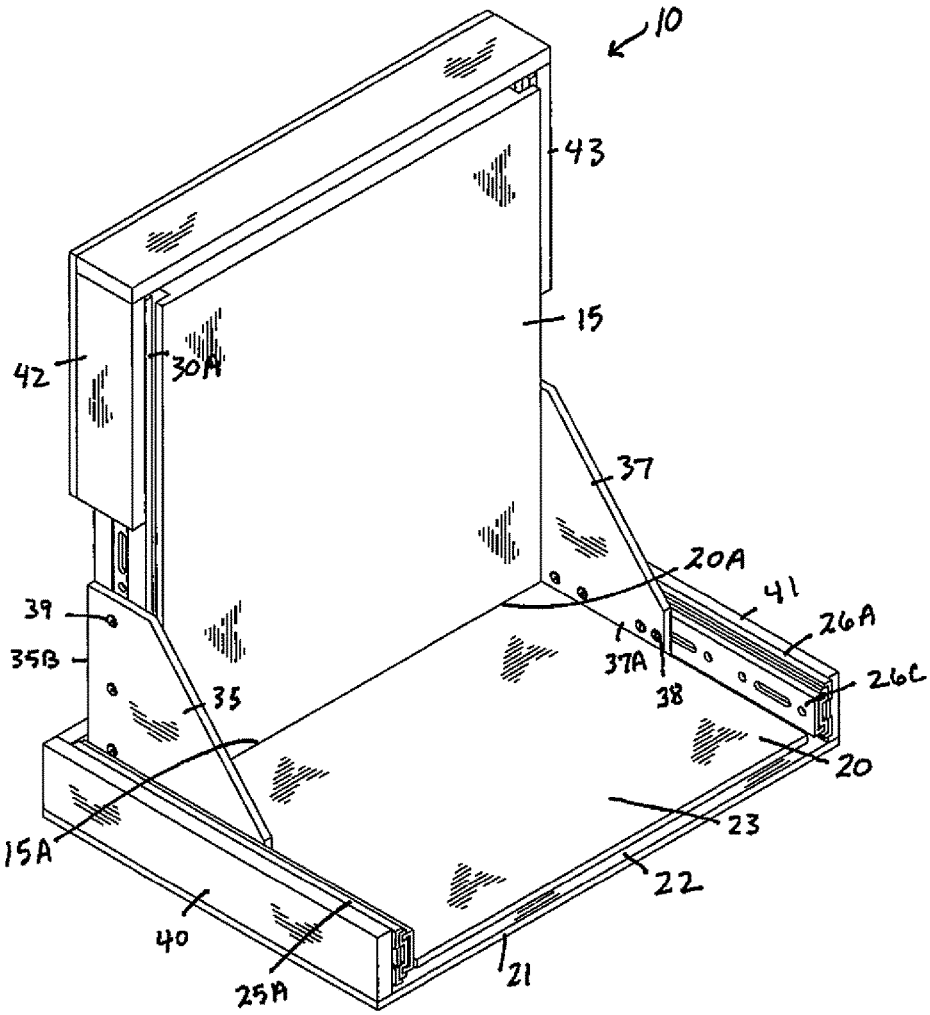
FIG. 1 is a front perspective view of an example embodiment of an upper-shelf assembly.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The upper-shelf assembly of the present invention is generally directed to a shelving assembly used within a storage cabinet, on a selected shelf within the storage cabinet, preferably on the upper, most difficult to reach shelves. As will be understood, the upper-shelf assembly is supported within the storage cabinet.

The upper-shelf assembly generally defines a first, horizontally extended position, and a second, horizontally and vertically extended position that, as will be described, allows for ease of visibility of goods stored, as well as easy removal or replacement of goods stored on the upper shelves of the storage cabinet. As will be discussed, the upper-shelf assembly as disclosed consists of components configured and correlated with respect to each other so as to attain the desired objective.

In accordance with the present invention, there is provided an upper-shelf assembly designated as numeral 10. The assembly 10 generally includes a vertical rear wall 15 extending the width of the assembly, and a bottom surface 20 having a rear edge 20A that is in communication with a bottom edge 15A of the vertical rear wall 15.

As illustrated, the bottom surface 20 comprises a generally planar and rectangular shelf that is spaced 22 (see FIG. 1) from a lower surface 21 that is in abutting contact with the cabinet's selected shelf surface (not shown) when it is attached. As will be understood, such an arrangement aids in the managing of the assembly 10 in the defined first and second positions during application.

The prior art storage cabinet (not shown) typically has a door or doors on the front thereof. Typically, the upper-shelf assembly 10 is arranged on a selected shelf between the side panels of the storage cabinet. The upper-shelf assembly 10 having the rear wall 15 positioned to the side walls of the storage cabinet such that the rear wall 15 is parallel with the back wall of the storage cabinet, and the bottom surface 20 is positioned parallel with the top surface of the selected shelf. Further, as is known, residential and commercial cabinets are made in a variety of sizes. It will be appreciated that the upper-shelf assembly 10 may be dimensioned and readily adapted as required to fit within the cabinet and provide the greatest amount of possible shelf space.

As illustrated, the assembly 10 includes a first position (see FIG. 2) where the assembly 10, including the bottom surface 20, is horizontally extended from the cabinet's selected shelf surface, and a second position (see FIG. 3) where the assembly 10 including the bottom surface 20 is horizontally extended and vertically lowered from the selected shelf surface.

The assembly includes a pair of horizontal base tracks 25A, 26A and vertical base tracks 30A, 31A. In application, the horizontal base tracks 25A, 26A are appropriately fastened to the side wall members 40, 41, respectively, that are appropriately fastened to the side walls of the storage cabinet. Similarly, the vertical base tracks 30A, 31A are appropriately fastened to the side wall members 42, 43, respectively, that are appropriately fastened to the side walls of the storage cabinet.

As illustrated, the pair of horizontal base tracks 25A, 26A are aligned parallel to each other on opposite sides of the cabinet's selected shelf and are perpendicular to the pair of vertical base tracks 30A, 31A that are similarly aligned parallel to each other on opposite side walls of the cabinet.

Various means of securing the assembly 10 to the storage cabinet as described may be used. The members 40, 41, 42 and 43 may be secured to the storage cabinet using well-known techniques, such as fasteners or adhesives.

Figure 3:
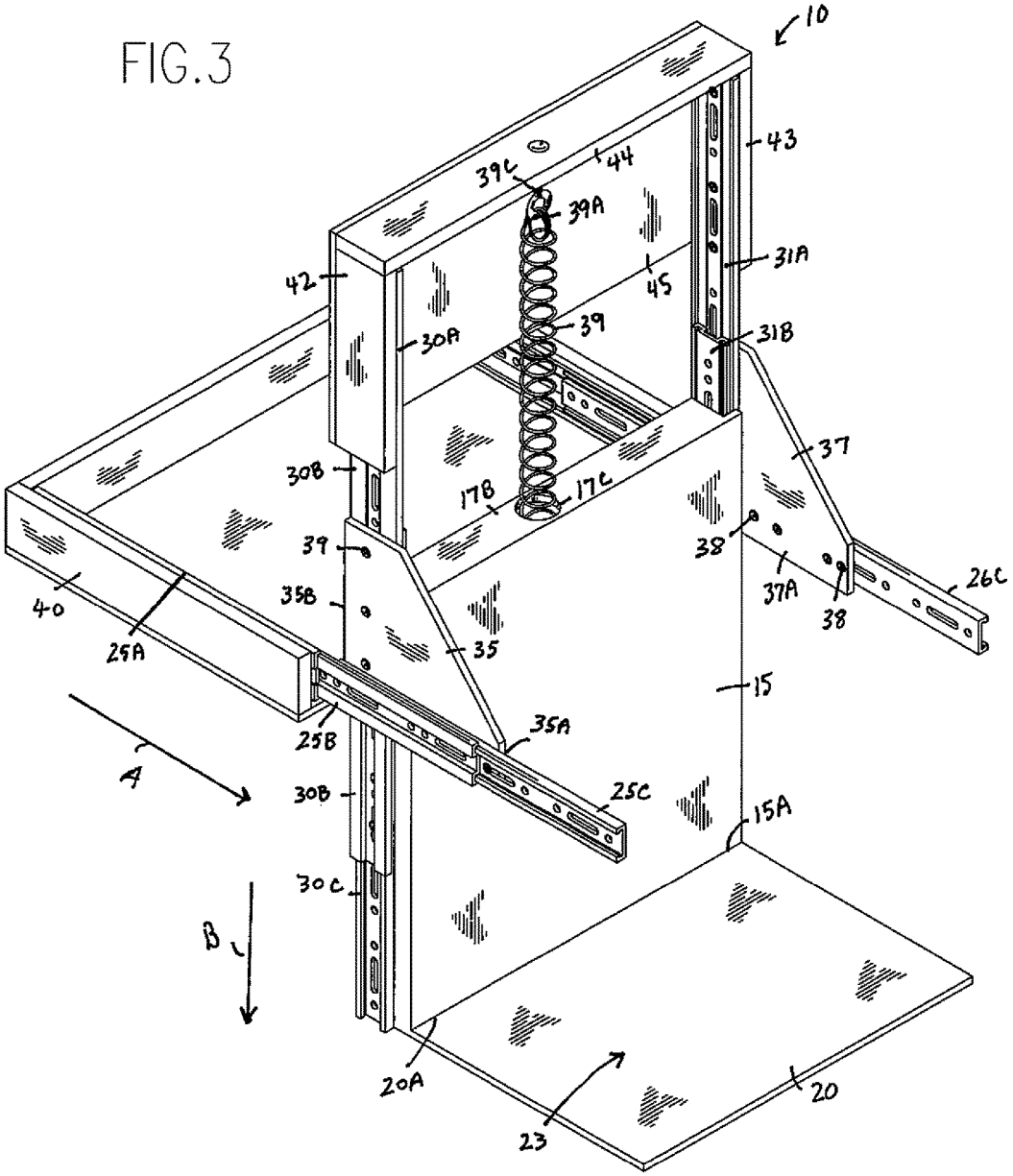
FIG. 3 is a front perspective view of the upper-shelf assembly extended both in a horizontal and vertical direction.

As best shown in FIG. 3, the horizontal base tracks 25A, 26A are appropriately mounted in a spaced parallel relationship by fasteners to the sides members 40, 41 that are fastened to the sides of the storage cabinet as described. First extension members 25B, 26B are slidingly received in the base tracks 25A, 26A, respectively, and are configured to enable the first extension members 25B, 26B (along with the bottom surface 20, the vertical base tracks 30A, 31A, and the vertical rear wall 15) to telescope into and away from the cabinet's selected shelf in a horizontal orientation. Similarly, the vertical base tracks 30A, 31A are appropriately mounted in a spaced parallel relationship by fasteners to the side members 42, 43 that are fastened to the sides of the storage cabinet as described. First extension members 30B, 31B are slidingly received in the base tracks 30A, 31A, respectively, and configured to enable the first extension members 30B, 31B (along with the bottom surface 20 and vertical rear wall 15) to telescope towards and away from the shelf 103 in a vertical orientation.

The horizontal base tracks 25A, 26A may further include second extension members 25C, 26C that are slidingly received in the first extension members 25B, 26B, respectively, and configured to enable the second extension members 25C, 26C (along with the bottom surface 20, the vertical base tracks 30A, 31A, and the vertical rear wall 15) to telescope into and away from the cabinet's selected shelf in a horizontal orientation. Similarly, the vertical base tracks 30A, 31A, may include second extension members 30C, 31C that are slidingly received in the first extension members 30B, 31B, respectively, and configured to enable the second extension members 30C, 31C (along with the bottom surface 20 and vertical rear wall 15) to telescope towards and away from the cabinet's selected shelf in a vertical orientation.

As illustrated, the assembly 10 further includes a pair of side members 35, 37 having a lower edge 35A, 37A appropriately attached 38 to the inner portion 25*k*, 26A' of the horizontal base tracks 25A, 26A, and a side edge 35B, 37B appropriately attached 39 to the outer portion 30A', 31A' of the vertical base tracks 30A, 31A. As illustrated, the side members 35, 37 are disposed on opposite sides of the assembly 10 and in effect form partial side walls to the bottom surface 20 when the assembly is in the rest or storage position as shown in FIGS. 1 and 2.

In application, the assembly 10 includes a storage position as shown in FIG. 1, where the assembly 10 is positioned with the cabinet's selected shelf and various goods (not shown) may be stored on an unobstructed space, a top surface 23 of the bottom surface 20.

Figure 2:
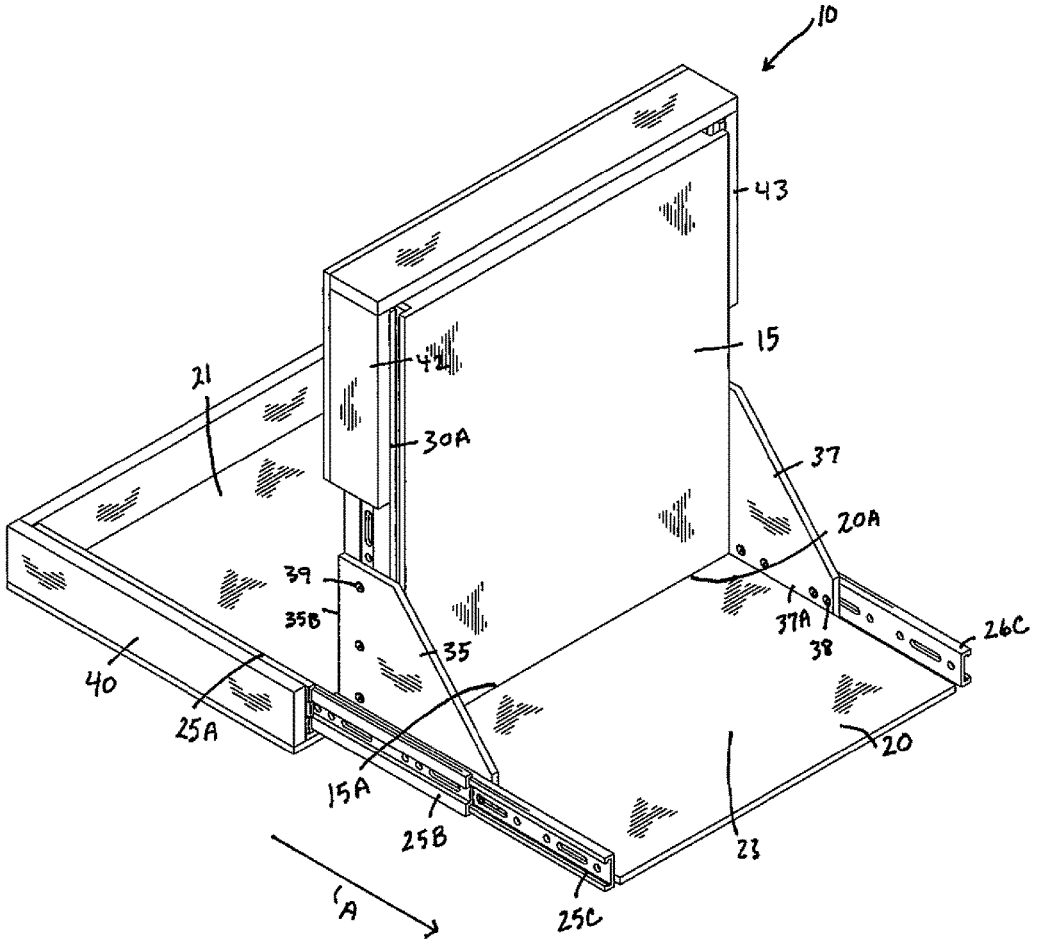
FIG. 2 is a front perspective view of the upper-shelf assembly extended in a horizontal direction.

The assembly 10 may be manually urged to the first position as shown in FIG. 2, where the assembly, including the vertical rear wall 15 and bottom surface 20, is horizontally (arrow A) extended from the cabinet's selected shelf; and, as shown in FIG. 3, the assembly may then be manually urged to the second position where the assembly including the vertical rear wall 15 and bottom surface 20 is horizontally (arrow A) extended and then vertically (arrow B) lowered from the cabinet's selected shelf.

As should be understood, when the assembly is placed in the first position as described, and certainly in the second position as described where the bottom surface 20 having the goods are now lowered from the selected shelf allows for easier visibility, and easier removal or replacement of stored goods.

To provide strength, durability and relatively low cost of manufacturing and purchasing, a upper-shelf assembly may be manufactured of a metal or a hard plastic; other materials and/or means of forming the illustrated embodiments or any variation thereof are considered to be within the scope of the inventive concept as defined in the appended claims.

A top cover 45 may be attached to the back side 10A of the assembly 10 to partially cover and protect a compression spring member 39 vertically disposed between an upper portion 44 of the assembly 10 and a lower end 17A of the vertical rear wall 15. In particular, a first end 39A of the spring member 39 is appropriately attached 39C to the upper portion 44 (see FIGS. 3 and 4), and the length of the spring member 39 passes through an aperture 17C disposed in an upper end 17B of the vertical rear wall 15 (see FIG. 3) and a second end 39B of the spring member 39 is appropriately attached 39D to the lower end 17A (see FIG. 4).

Figure 4:
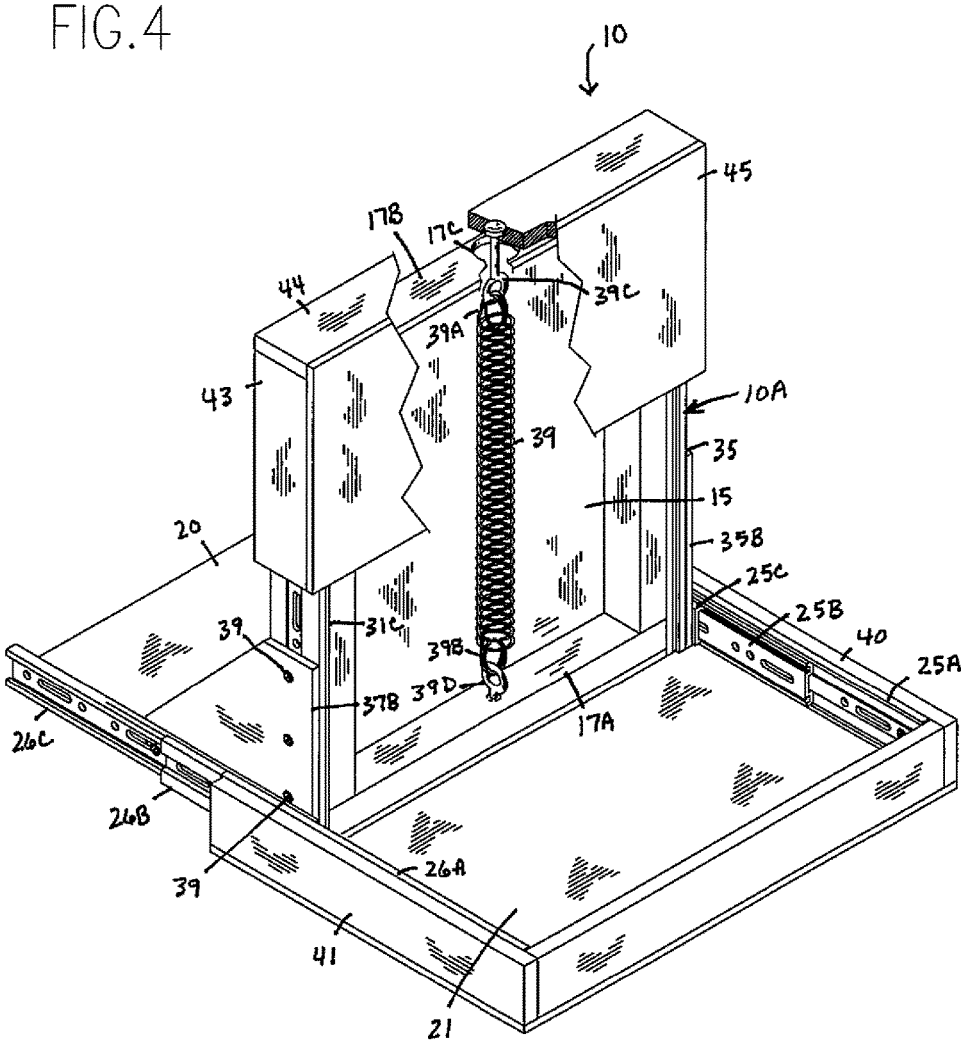
FIG. 4 is a sectional view of the back side of the upper-shelf assembly in the first position as shown in FIG. 2, illustrating connection of the spring member.

FIG. 3 shows the spring member 39 in a stretched position where the assembly 10 is vertically extended as described. FIG. 4 shows the spring member 39 in its original, compressed state with the assembly 10 in the rest or first position as described. As should be understood, the at least one spring member 39 is configured to counterbalance downward movement of the assembly 10 from the first position to the second position as described, and assist in returning the assembly from the second position to the first position.

Although the above description above contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. An upper shelf assembly comprising:

a vertical rear wall extending the width of the assembly, and a bottom surface in communication with the vertical rear wall, a pair of horizontal base tracks mounted in a spaced parallel relationship by fasteners with opposite sides of a storage cabinet, said horizontal base tracks are slidingly retractable in a horizontal orientation, a pair of vertical base tracks mounted in a spaced parallel relationship by fasteners with the opposite sides of the storage cabinet, said vertical base tracks are slidingly retractable in a vertical orientation, a pair of side members having a lower edge attached to the horizontal base tracks and a side edge attached to the vertical base tracks, a spring member having a first end attached to a lower end of said vertical rear wall and a body portion that passes through an aperture disposed in an upper end of said vertical rear wall so that a second end of said spring member is attached to an upper portion of the assembly, and wherein the assembly includes a rest or storage position where the assembly is positioned with a selected shelf in the storage cabinet, a first position where the vertical rear wall and bottom surface are horizontally extended from the selected shelf and, a second position where the vertical rear wall and bottom surface are horizontally extended and then vertically lowered from the selected shelf.

2. The assembly of claim 1, wherein said vertical rear wall is positioned to the side walls of the storage cabinet such that the vertical rear wall is parallel with the storage cabinet's back wall, and said bottom surface is positioned parallel with a top surface of the selected shelf.

3. The assembly of claim 2, wherein said bottom surface comprises a generally planar and rectangular shelf.

4. The assembly of claim 3, wherein first horizontal extension members are slidingly received in each of said pair of horizontal base tracks such that said first horizontal extension members are configured to telescope into and away from the selected shelf in a horizontal orientation, and wherein first vertical extension members are slidingly received in each of said pair of vertical base tracks such that said first vertical extension members are configured to telescope towards and away from the selected shelf in a vertical orientation.

5. The assembly of claim 4, wherein second horizontal extension members are slidingly received in said first horizontal extension members such that said second horizontal extension members are configured to telescope into and away from the selected shelf in a horizontal orientation, and wherein second vertical extension members are slidingly received in said first vertical extension members such that said second vertical extension members are configured to telescope towards and away from the selected shelf in a vertical orientation.

6. An upper-shelf assembly supported within a storage cabinet, said assembly comprising:

a vertical rear wall and a bottom surface having a rear edge that abuts a bottom edge of said vertical rear wall, and wherein said bottom surfaced is spaced from a selected shelf within a storage's cabinet, a pair of horizontal base tracks that are aligned parallel to each other on opposite sides of the selected shelf and perpendicular to a pair of vertical base tracks that are aligned parallel to each other on opposite side walls of the storage cabinet, a spring member having a first end attached to a lower end of said vertical rear wall and a body portion that passes through an aperture disposed in an upper end of said vertical rear wall so that a second end of said spring member is attached to an upper surface and wherein said upper surface is positioned above said upper end, and wherein first horizontal extension members are slidingly received in said pair of horizontal base tracks such that said first horizontal extension members are configured to telescope into and away from the selected shelf in a horizontal orientation, and wherein first vertical extension members are slidingly received in said vertical base tracks such that said first vertical extension members are configured to telescope towards and away from the selected shelf in a vertical orientation.

7. The assembly of claim 6, wherein said vertical rear wall is positioned to the side walls of the storage cabinet such that the vertical rear wall is parallel with the storage cabinet's back wall, and said bottom surface is positioned parallel with a top surface of the selected shelf.

8. The assembly of claim 7, wherein said bottom surface comprises a generally planar and rectangular shelf.

9. The assembly of claim 8, further including a pair of side members having lower edges attached to said horizontal base tracks, and side edges attached to said vertical base tracks, and wherein said pair of side members are disposed on opposite sides of the assembly.

10. The assembly of claim 6, wherein second horizontal extension members are slidingly received in said first horizontal extension members such that said second horizontal extension members are configured to telescope into and away from the selected shelf in a horizontal orientation, and wherein second vertical extension members are slidingly received in said first vertical extension members such that said second vertical extension members are configured to telescope towards and away from the selected shelf in a vertical orientation.

11. The assembly of claim 6, wherein said second end of said spring member is attached to the upper surface of said assembly.

12. The assembly of claim 6, wherein said second end of said spring member is attached to the upper surface of the storage cabinet.

13. An upper shelf assembly comprising:

a vertical rear wall, and a bottom surface in communication with the vertical rear wall, a pair of horizontal base tracks mounted in a spaced parallel relationship by fasteners with opposite sides of a storage cabinet, said horizontal base tracks are slidingly retractable in a horizontal orientation, a pair of vertical base tracks mounted in a spaced parallel relationship by fasteners with the opposite sides of the storage cabinet, said vertical base tracks are slidingly retractable in a vertical orientation, a vertical spring member having a first end connected to a lower end of said vertical rear wall and a body portion that passes through an aperture disposed in an upper end of said vertical rear wall and a second end connected to an upper surface that is positioned above said upper end, and wherein the assembly includes a rest position where the assembly is positioned with a selected shelf in the storage cabinet, a first position where the vertical rear wall and bottom surface are horizontally extended from the selected shelf and, a second position where the vertical rear wall and bottom surface are horizontally extended and then vertically lowered from the selected shelf.

14. The assembly of claim 13, wherein said vertical rear wall is positioned to the side walls of the storage cabinet such that the vertical rear wall is parallel with the storage cabinet's back wall, and said bottom surface is positioned parallel with a top surface of the selected shelf.

15. The assembly of claim 14, wherein said bottom surface comprises a generally planar and rectangular shelf.

16. The assembly of claim 15, further including a pair of side members having lower edges attached to said horizontal base tracks, and upper edges attached to said vertical base tracks, and wherein said pair of side members are disposed on opposite sides of the assembly.

17. The assembly of claim 15, wherein first horizontal extension members are slidingly received in each of said pair of horizontal base tracks such that said first horizontal extension members are configured to telescope into and away from the selected shelf in a horizontal orientation, and wherein first vertical extension members are slidingly received in each of said pair of vertical base tracks such that said first vertical extension members are configured to telescope towards and away from the selected shelf in a vertical orientation.

18. The assembly of claim 17, wherein second horizontal extension members are slidingly received in said first horizontal extension members such that said second horizontal extension members are configured to telescope into and away from the selected shelf in a horizontal orientation, and wherein second vertical extension members are slidingly received in said first vertical extension members such that said second vertical extension members are configured to telescope towards and away from the selected shelf in a vertical orientation.

* * * * *